US006568304B2

(12) United States Patent
Ito et al.

(10) Patent No.: US 6,568,304 B2
(45) **Date of Patent: *May 27, 2003**

(54) METHOD FOR ORDER CHANGING IN CORRUGATING MACHINES

(75) Inventors: Masaharu Ito, Mihara (JP); Toshihide Kato, Mihara (JP); Takayuki Miyake, Mihara (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/430,502

(22) Filed: Oct. 29, 1999

(65) Prior Publication Data

US 2003/0037646 A1 Feb. 27, 2003

(30) Foreign Application Priority Data

Nov. 2, 1998 (JP) ..... 11-311530

(51) Int. Cl.[7] ..... B26D 7/06; B31B 1/16

(52) U.S. Cl. ..... 83/13; 83/408; 83/499; 83/508.3

(58) Field of Search ..... 83/408, 498, 499, 83/508.3, 75.5, 102, 428, 13; 700/167, 171; 493/82, 83, 374

(56) References Cited

U.S. PATENT DOCUMENTS

| | | | | |
|---|---|---|---|---|
| 4,265,152 A | | 5/1981 | Corradi | 83/106 |
| 4,266,112 A | * | 5/1981 | Niedermeyer | 83/428 |
| 4,268,341 A | * | 5/1981 | Huhne | 83/408 |
| 5,031,496 A | * | 7/1991 | Lobash et al. | 83/428 |
| 5,152,205 A | * | 10/1992 | Yoshida et al. | 83/304 |
| 5,360,161 A | * | 11/1994 | Schaller et al. | 83/408 |
| 5,363,730 A | * | 11/1994 | Besemann | 83/499 |
| 5,381,342 A | * | 1/1995 | Noe | 83/72 |
| 5,483,856 A | * | 1/1996 | Smitterberg et al. | 83/419 |
| 5,496,431 A | * | 3/1996 | Hirakawa et al. | 83/428 |
| 5,761,980 A | * | 6/1998 | Ima et al. | 83/508.3 |
| 5,857,395 A | * | 1/1999 | Bohm et al. | 83/408 |
| 5,918,519 A | * | 7/1999 | Schnabel et al. | 83/428 |
| 5,951,454 A | * | 9/1999 | Adami | 493/355 |
| 6,092,452 A | * | 7/2000 | Adami | 83/428 |
| 6,103,171 A | * | 8/2000 | Cummings | 83/408 |
| 6,117,381 A | * | 9/2000 | Cummings | 83/408 |
| 6,165,117 A | * | 12/2000 | Adami | 83/508.3 |

FOREIGN PATENT DOCUMENTS

| | | | |
|---|---|---|---|
| EP | 0065014 A1 | 11/1982 | B31B/1/16 |
| EP | 0468374 A2 | 1/1992 | B26D/1/38 |
| EP | 0607084 A1 | 7/1994 | B31B/1/16 |
| EP | 0737553 A1 | 10/1996 | B26D/9/00 |
| EP | 0795382 A2 | 9/1997 | B26D/5/00 |
| JP | 06-210772 A | 8/1994 | B31F/1/20 |

* cited by examiner

*Primary Examiner*—Allan N. Shoap
*Assistant Examiner*—Stephen Choi
(74) *Attorney, Agent, or Firm*—Myers Bigel Sibley & Sajovec

(57) ABSTRACT

An order changing method in a corrugating machine having a slitter scorer devices and a plurality of cut-off devices includes a step of aligning a dividing slit of an old order corrugated fiberboard web, which does not coincide with a centerline of the old order corrugated fiberboard web, with a dividing slit of a new order corrugated fiberboard web, which does not coincide with a centerline of the new order corrugated fiberboard web, wherein the new order corrugated fiberboard web has a width different from a width of the old order corrugated fiberboard web such that the method can decrease the number of defective sheets generated during an order change.

4 Claims, 6 Drawing Sheets

METHOD FOR ORDER CHANGING IN CORRUGATING MACHINES

BACKGROUND OF THE INVENTION

1. Field of the Invention

The present invention relates to an order changing method in a corrugating machine for manufacturing a corrugated fiberboard sheet. More particularly, the present invention relates to an order changing method in a corrugating machine having the paper patch and sheet taking arrangement of a corrugated fiberboard web in such a manner that dividing slits of the corrugated fiberboard web are set on an almost straight line before and after an order change.

2. Description of the Related Art

FIG. 5 is a conceptual view showing a part of the downstream side of a corrugating machine for manufacturing a corrugated fiberboard sheet. In FIG. 5, a slitter scorer state 101 is provided on the right side and a cut-off stage 102 is provided on the left side. Cutting and creasing are performed while a corrugated fiberboard web 103 is running from the slitter scorer stage 101 toward the cut-off stage.

The slitter scorer stage 101 comprises one cutter 104 and two slitter scorer devices 105*a* and 105*b*. One of the slitter scorer devices 105*a* and 105*b* is usually operated, and the other is kept with the setting switched to cutting conditions corresponding to the next order.

Trim ducts 150*a* and 150*b* for sucking a trim of the corrugated fiberboard web 103 are provided behind the slitter scorer devices 105*a* and 105*b*, respectively.

The cut-off stage 102 positioned on the downstream side of the slitter scorer step 101 comprises upper- and lower-stage cut-off devices 106 and 107 for cutting the corrugated fiberboard web 103 in a transverse direction orthogonal to a running direction thereof (hereinafter referred to as a flow direction or a progress direction).

According to such a corrugating machine 110, the corrugated fiberboard web 103 stuck by means of a double facer (not shown) which is provided on the upstream side is in the progress direction of the corrugated fiberboard web 103 at the slitter scorer stage 101, and is then cut to have the same length in the transverse direction at the cut-off stage 102. Consequently, a plurality of rectangular corrugated fiberboard sheets 111 and 112 shown in FIG. 6 can be manufactured. The corrugated fiberboard sheets 111 and 112 are stacked by means of a stacker.

Next, description will be given to a sheet taking operation to be performed by the corrugating machine 110. The above-mentioned cut-off operation means a so-called double cut-off operation to be performed by the two cut-off devices 106 and 107. FIG. 6 is a plan view showing the sheet taking operation for processing the corrugated fiberboard web 103 by the double cut-off operation.

The corrugated fiberboard web 103 is cut into a plurality of portions along slitter cutting lines 120 in the flow direction of the corrugated fiberboard web 103 at the slitter scorer step 101. By using, as a boundary, a dividing slit M which is one of the slitter cutting lines 120, for example, an upper web 103*a* positioned on the upper side in FIG. 6 and a lower web 103*b* are fed to the upper-stage cut-off device 106 and the lower-stage cut-off device 107 respectively, and are cut by cut-off lines 121 and 122 in the transverse direction of the corrugated fiberboard web 103 and are cut away at equal intervals in the flow direction respectively. Thus, the rectangular corrugated fiberboard sheets 111 and 112 having different dimensions can be manufactured in the upper-stage cut-off device 106 and the lower-stage cut-off device 107, respectively.

For example, when the corrugated fiberboard sheets 111 and 112 having different sizes are being processed by the upper-stage cut-off device 106 and the lower-stage cut-off device 107, a dimension of the sheet to be cut by the cut-off devices 106 and 107 is changed in some cases. This change is referred to as an order change. The order change is performed in the following two cases.

(1) Only one of the upper- and lower-stage cut-off devices 106 and 107 is subjected to the order change.

For example, the corrugated fiberboard sheets 111 and 112 are manufactured in independent production lots by the upper- and lower-stage cut-off devices 106 and 107, respectively. Therefore, even if a predetermined number of corrugated fiberboard sheets have been manufactured in one of the upper and lower stages, the production is rarely finished at the same time in the other stage. Accordingly, if the production is completed in one of the upper and lower stages (for example, the upper stage side 106), it is necessary to newly change the order. In addition, if the kind of paper does not need to be changed but only the width of the paper is to be changed, the production should be continued with the same order in another stage (for example, the lower stage side 107).

(2) Before and after the order change, both the upper- and lower-stage cut-off devices 106 and 107 are subjected to the order change. At this time, it does not matter if the kind of paper is changed.

Various order changing methods to be used in the corrugating machine 110 have conventionally been proposed. As one of examples, a method described in Japanese Unexamined Patent Publication No. Hei 6-210772 will be described below with reference to FIG. 7. FIG. 5 described above illustrates equipment based on the method.

FIG. 7 shows a case in which the upper-stage cut-off device 106 maintains the same order and the lower-stage cut-off device 107 performs an order change to manufacture a product having a smaller width. Accordingly, a web width is reduced according to the width of the product before and after the order change.

First of all, a corrugated fiberboard web 103*x* having an old order is processed by the slitter scorer device 105*a* shown in FIG. 5. In the slitter scorer device 105*a*, the corrugated fiberboard web 103*x* is cut by a slitter cutting line 120*x* and a dividing slit Mx shown in FIG. 7. Therefore, both ends 160*x* and 160*x* of the corrugated fiberboard web 103*x* in a transverse direction act as trims. The trims 160*x* and 160*x* are sucked into the above-mentioned trim duct 150*a* (150*b*) and are removed.

Next, upper and lower shafts of the slitter scorer device 105*a* are opened in a proper position on this side of a paper patch portion, thereby stopping the cutting. In advance, a trim cutting line 130 should be formed on the ends of the corrugated fiberboard webs 103*x* and 103*y* by a rotary shear (not shown).

The reason why the trim cutting line 130 should be formed will be described below. In a case where the trim cutting line 130 is not formed on the trim 160*x* of the corrugated fiberboard web 103*x* having an old order, there is a possibility that the corrugated fiberboard web 103*x* might be pulled by the trim 160*x* and hit against the trim duct 150*a*, thereby causing jam-up or the like.

Furthermore, if the trim cutting line 130 is not formed on trims 160*y* and 160*y* of the corrugated fiberboard web 103*y* having a new order, the trims 160*y* and 160*y* are kept coupled to the corrugated fiberboard web 103*y* so that the corrugated fiberboard web 103*y* is not sucked into the trim duct 150*a*. Alternatively, if the corrugated fiberboard web 103*y* is forcedly sucked into the trim duct 150*a* with the trims 160*y* and 160*y* kept coupled to the corrugated fiberboard web 103*y*, there is a possibility that an inconvenience might be caused, that is, the trim duct 150*a* becomes clogged.

In order to denote parts before and after the order change by designations, particularly, an old order before the order change is indicated as x, and a new order after the order change is indicated as y.

Next, a paper patch portion is interposed to form a proper space, thereby operating the slitter scorer device 105*b*. Thus, the cutting of the corrugated fiberboard web 103*y* having a new order is started. In an order changing area 131, slitter cutting lines 120*x* and 120*y* having old and new orders are not provided. A dividing slit N is formed in the order changing area OC by a cutter 104 and the corrugated fiberboard web 103 to be fed to the upper- and lower-stage cut-off devices 106 and 107 is divided into two portions. Consequently, the order change can be performed without separating the corrugated fiberboard web 103*x* having the old order from the corrugated fiberboard web 103*y* having the new order before and after the order change.

Conventionally, the corrugated fiberboard web 103 is generally passed with the centers of the old and new corrugated fiberboard webs 103*x* and 103*y* in the transverse direction aligned with the center of the corrugating machine 110. On the assumption that such a method is used, equipment itself has been designed. For example, generally, a stage roll and a pressure roll are pressurized by a single facer, a double facer and the like symmetrically horizontally based on the center of a machine. Accordingly, dividing slits Mx and My of the old and new webs for dividing the corrugated fiberboard webs 103*x* and 103*y* to be fed to the upper- and lower-stage cut-off devices 106 and 107 are changed in the transverse direction, respectively.

However, the conventional order changing method in the corrugating machine described above has had the following problems.

(1) The order changing area OC is provided on the paper patch portions of the old and new corrugated fiberboard webs 103*x* and 103*y*. Correspondingly, defective sheets 131*x* and 131*y* which cannot become products have lengths increased.

(2) Moreover, the positions of the dividing slits Mx and My are moved in the transverse direction. Consequently, it is necessary to reset the vertical distributing position of a slat of a web director 132 shown in FIG. 5 in a very short time according to a timing of passage through the order changing area OC. If the setting cannot be well performed, the corrugated fiberboard web 103 cannot be supported stably so that jam-up and poor precision are caused.

(3) Furthermore, the stacking portion of the stacker provided on the upper-stage cut-off device 106 cannot perform a continuous stacking operation because a sheet discharge position is changed in the transverse direction irrespective of the same order. Therefore, it is necessary to expel a stack once during the stacking operation and to newly perform the stacking operation.

SUMMARY OF THE INVENTION

In consideration of the above-mentioned conventional problems, it is an object of the present invention to provide an order changing method in a corrugating machine which can decrease the number of defective sheets generated during an order change and can perform a continuous stacking operation in a stacking portion of an upper-stage stacker.

In order to achieve the above-mentioned object, the present invention provides an order changing method in a corrugating machine comprising a slitter scorer device and a plurality of cut-off devices, the method comprising, in the slitter scorer device, the steps of:

cutting a corrugated fiberboard web along slitter cutting lines in a running direction thereof;

dividing the cut corrugated fiberboard webs into at least two portions by using, as a boundary, a dividing slit which is one of the slitter cutting lines; and feeding the divided corrugated fiberboard webs to the cut-off device, and the method comprising, in the cut-off device, the steps of:

cutting and separating each of the corrugated fiberboard webs in a direction orthogonal to the running direction thereof, supplying the corrugated fiberboard web having a new order followed by the corrugated fiberboard web having an old order; and setting a dividing slit of the corrugated fiberboard web having an old order and a dividing slit of the corrugated fiberboard web having a new order on almost the same straight line when making a change from the corrugated fiberboard web having an old order to the corrugated fiberboard web having a new order.

The above-mentioned order changing method can be employed in upper- and lower-stage cut-off devices, for example, and can continuously perform production with the same order in the upper-stage cut-off device and can cope with an order change in which the kind of paper is not changed but only a width thereof is to be changed in the lower-stage cut-off device. In this case, it is not necessary to change the position of a stacker provided on the upper-stage cut-off device and to perform a stacking operation again. Furthermore, the order changing method can also cope with an order change in which the web widths should be changed in the upper- and lower-stage cut-off devices.

Moreover, other embodiment of the present invention is the order changing method in a corrugating machine, further comprising the step of cutting both ends in the cross direction of the corrugated fiberboard webs having new and old orders and sucking a trim obtained by the cutting by means of a trim duct.

And, the present invention can further adopt the order changing method in a corrugating machine, wherein means for cutting the corrugated fiberboard web in the slitter scorer device serves to perform the cutting by means of slitter knives provided vertically in the slitter scorer device.

According to the above-mentioned order changing method, the dividing slits are set on almost the same straight line before and after the order change. Therefore, an extra length equivalent to the conventional order changing area is eliminated. Therefore, the loss of sheets can be reduced.

As described above, the order changing method in the corrugating machine according to the present invention has the following effects.

(1) The position of the dividing slit is not changed in the transverse direction before and after the order change. Therefore, it is not necessary to change the setting of a web guide. Consequently, the causes of the generation of jam-up can be reduced.

(2) In a case where one of the cut-off devices continues the same order, the position of the stacker is not changed in the transverse direction after a cut-off operation. Therefore, it is not necessary to perform the stacking operation again. Consequently, the causes of the disorder of sheets on the stacker and the jam-up can be eliminated.

(3) The extra length equivalent to the conventional order changing area is eliminated. Therefore, it is possible to decrease the loss of sheets.

DETAILED DESCRIPTION OF PREFERRED EMBODIMENTS

Figure 1:
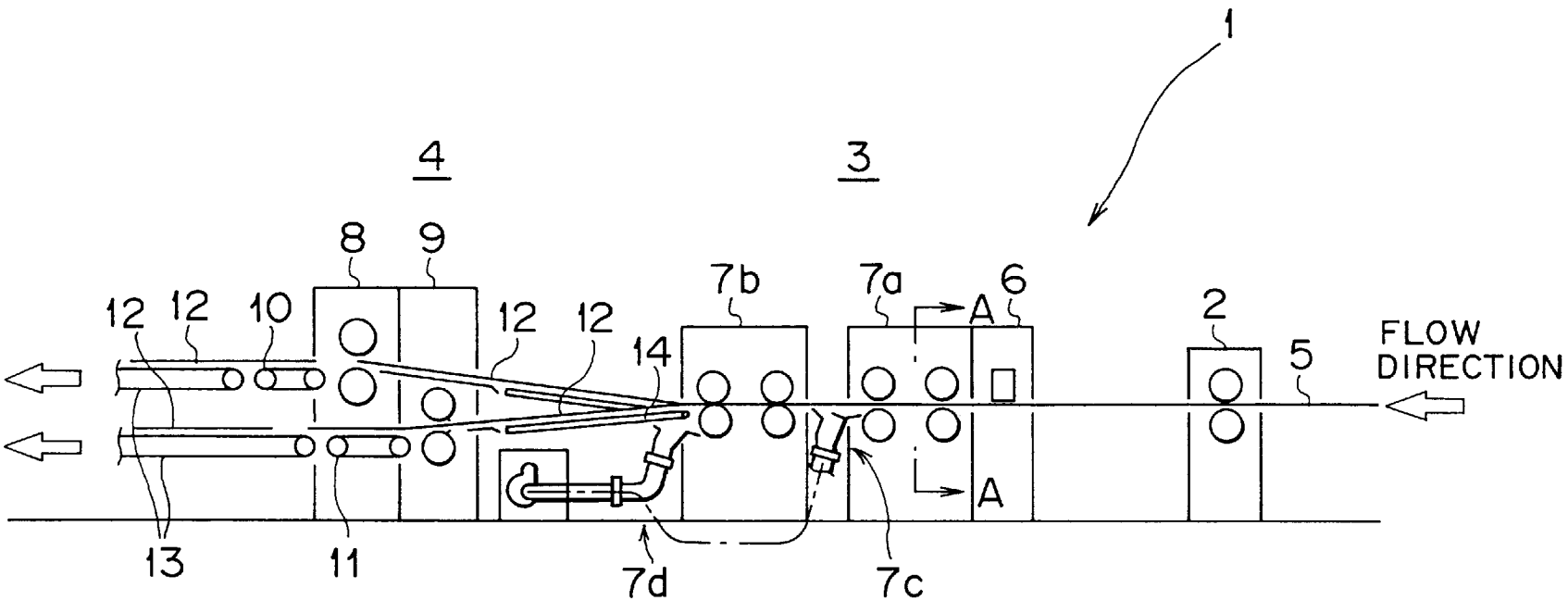
FIG. 1 is a conceptual view showing a latter half part of a corrugating machine to which an order changing method according to the present invention is applied.

A corrugating machine performing an order changing method according to an embodiment of the present invention will be described below in detail with reference to the drawings. FIG. 1 is a conceptual view showing a latter half part of the corrugating machine 1. A rotary shear 2 is provided on a right end in FIG. 1. A slitter scorer step 3 and a cut-off step 4 are provided on the downstream side of the rotary shear 2. A double facer which is not shown is provided on the upstream side of the rotary shear 2.

The rotary shear 2 is a device for cutting a corrugated fiberboard web 5 in a transverse direction which is manufactured continuously at a former step and for forming a notch on both ends of the corrugated fiberboard web 5 in the transverse direction.

The slitter scorer step 3 comprises one cutter 6, two slitter scorer devices 7*a* and 7*b*, and trim ducts 7*c* and 7*d*. The slitter scorer devices 7*a* and 7*b* serve to perform the creasing of a corrugated fiberboard box on the running corrugated fiberboard web 5 and to cut the corrugated fiberboard web 5 to have a predetermined width in a flow direction. Thus, a plurality of sheets can be manufactured at the same time, that is, a multiple taking operation can be carried out. Furthermore, the trim ducts 7*c* and 7*d* are provided behind the slitter scorer devices 7*a* and 7*b* respectively, and serve to suck trims 23*x* and 23*y* of the corrugated fiberboard web 5 shown in FIG. 3 by air and to remove them.

Figure 2:
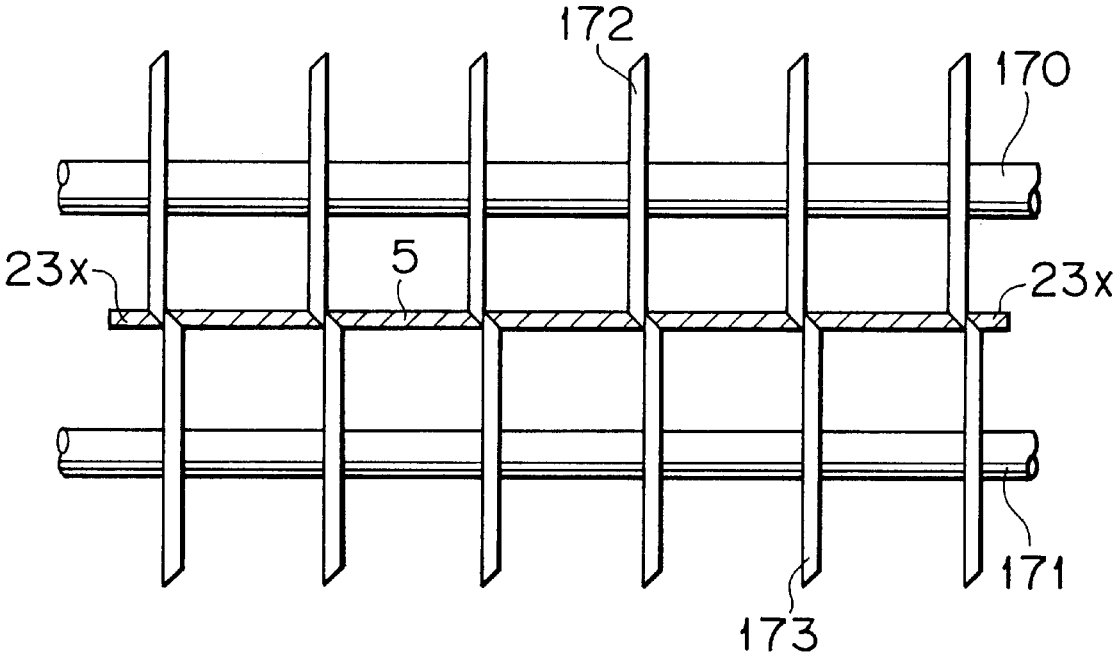
FIG. 2 is a sectional view taken along the line A—A in FIG. 1.

With reference to FIG. 2, the trims 23*x* and 23*y* will be described below. FIG. 2 is a sectional view taken along the line A—A in FIG. 1. In the slitter scorer device 7*a*, rotary shafts 170 and 171 are supported vertically and are provided with slitter knives 172 and 173 at regular intervals. The ends of the corrugated fiberboard web 5 in the transverse direction are cut by the outermost one of the slitter knives 172 and 173, thereby forming the trims 23*x* and 23*y*.

The trims 23*x* and 23*y* are provided for the following purpose.

The corrugated fiberboard web 5 is formed by sticking a plurality of sheets together. Therefore, the shift of the sheets is easily caused. Furthermore, the corrugated fiberboard web 5 meanders during running. Therefore, the ends should be cut to obtain an accurate sheet width. In addition, the two slitter scorer devices 7*a* and 7*b* are provided in the flow direction of the corrugated fiberboard web 5. By alternately using the slitter scorer devices 7*a* and 7*b* every order change, consequently, it is possible to shorten a time taken for a resetting operation to be performed along with an order change.

The cut-off step 4 comprises the upper-stage cut-off device 8 and the lower-stage cut-off device 9, defective removing devices 10 and 11, and a stacker 13 (a part of which is shown in FIG. 1). The cut-off devices 8 and 9 serve to cut the corrugated fiberboard web 5 at the slitter scorer step 3 in the transverse direction orthogonal to a progress direction thereof. The defective removing devices 10 and 11 are provided adjacently to the cut-off devices 8 and 9, and discharge a paper patch portion between an old order and a new order which is cut with a predetermined defective portion cutting length, respectively. Furthermore, the stacker 13 is provided on the downstream side of the defective removing devices 10 and 11, and serves to stack a rectangular sheet 12 cut by the cut-off devices 8 and 9. The cut-off devices 8 and 9, the defective removing devices 10 and 11, and the stackers 13 and 13 are of a so-called double cut-off type in which two sets are provided, respectively. The cut-off device 9 provided on the upstream side is an upper-stage cut-off device for feeding the corrugated fiberboard web 5 to the lower stage side by a web director 14 and for then cutting the corrugated fiberboard web 5, and the cut-off device 8 provided on the downstream side is a lower-stage cut-off device for feeding the corrugated fiberboard web 5 to the upper stage side by the web director 14 and for then cutting the corrugated fiberboard web 5. The corrugating machine 1 performs the creasing of a corrugated fiberboard box on the corrugated fiberboard web 5 stuck by a double facer (not shown) provided on the upstream side at the slitter scorer step 3, and forms a plurality of slitter cutting lines (hereinafter referred to as cutting lines) 20 shown in FIG. 3 to have a predetermined length in the progress direction of the corrugated fiberboard web 5, thereby performing a cutting operation. The corrugated fiberboard web 5 cut into a plurality of portions is divided into two parts in the transverse direction by using, as a boundary, a dividing slit M which is one of the cutting lines 20. The two parts are fed to the two cut-off devices 8 and 9, respectively. In the cut-off devices 8 and 9, the corrugated fiberboard web 5 is cut into rectangular corrugated fiberboard sheets 22*a* and 22*b* having predetermined sizes by a cut-off line 21 shown in FIG. 3 in the transverse direction orthogonal to the progress direction. The corrugated fiberboard sheets 22*a* and 22*b* are stacked by the stacker 13.

Figure 3:
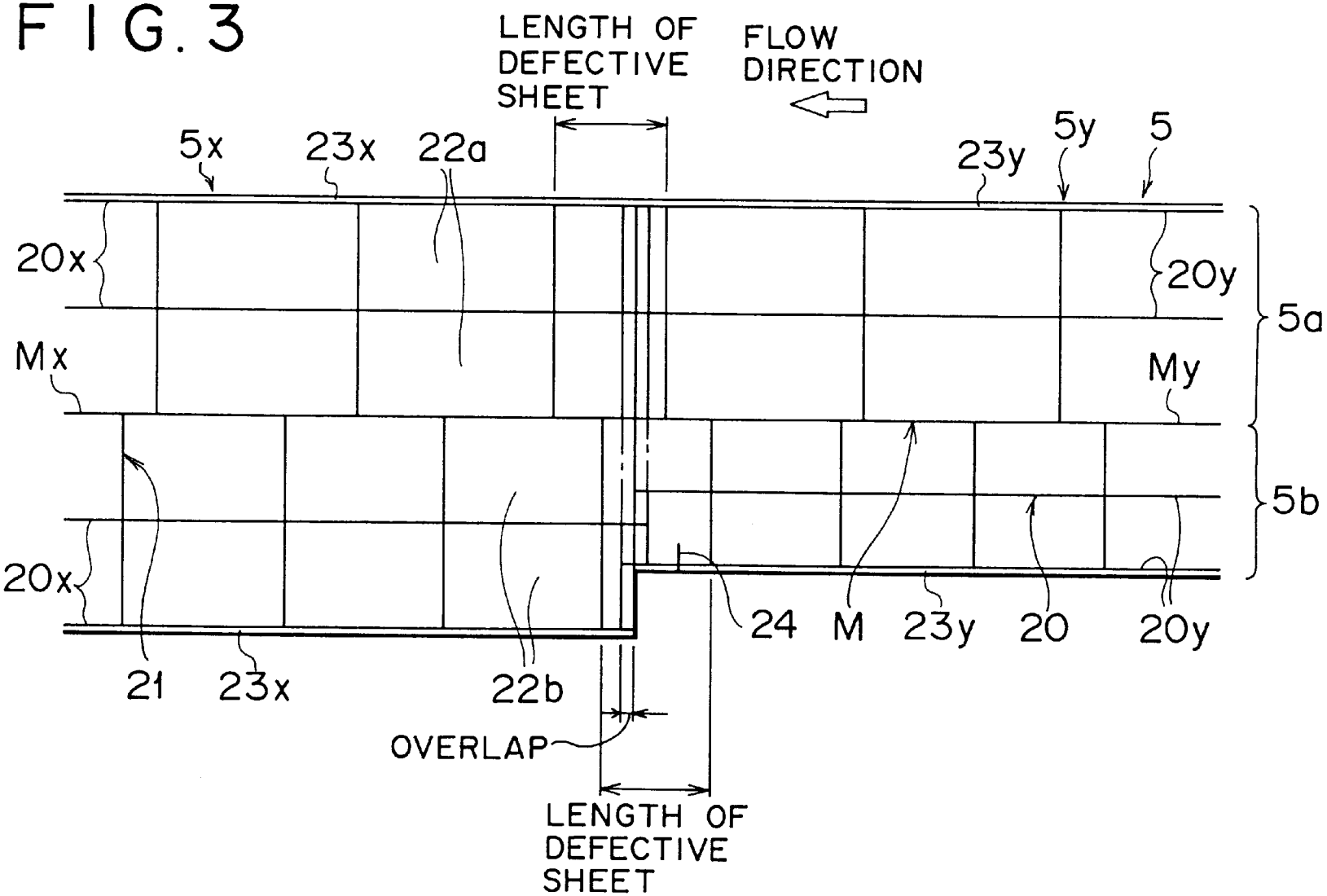
FIG. 3 is a plan view showing a corrugated fiberboard web in which a sheet taking operation has been performed by an order changing method according to an embodiment of the present invention.

With reference to FIG. 3, description will be given to a sheet taking operation to be performed before and after the order change of the old and new corrugated fiberboard webs 5*x* and 5*y*.

The present invention is characterized in that a product is taken in such a manner that the centers of the old and new corrugated fiberboard webs 5x and 5y in the transverse direction are not conventionally made coincident with each other but a dividing slit Mx before the order change and a dividing slit My after the order change are set on almost the same straight line when the order change is to be performed.

FIG. 3 shows an example of the order change in which continuous production is performed with the same order in one of the two cut-off devices 8 and 9 and the kind of paper is not changed but only a width thereof is varied in the other cut-off device 8 or 9. For example, in a case where an upper web 5a positioned on the upper side in FIG. 3 is fed to the upper-stage cut-off device 8 and is cut in the transverse direction and a lower web 5b provided on the lower side is fed to the lower-stage cut-off device 9 and is cut in the transverse direction, the production is continued with the same order in the upper-stage cut-off device 8 and the order change is performed in the lower-stage cut-off device 9. In this case, it does not matter if a cutting length is changed.

The corrugated fiberboard webs 5x and 5y perform a paper patching operation in such a manner that their dividing slits Mx and My are coincident with each other before and after the order change, that is, they are positioned on almost the same straight line. Accordingly, if the trims 23x and 23y have the same widths before and after the order change, the paper patching operation is carried out with the ends of the paper aligned with each other.

As shown in FIG. 1, in a case where the processing is performed with an old order by the slitters scorer device 7a and with a new order by the slitter scorer device 7b, a slitter cutting line 20x is formed up to the vicinity of the paper patch portion of the old order by the slitter scorer device 7a. Then, the slitter scorer device 7b is actuated to perform a processing in such a manner that at least a part of a slitter cutting line 20y of the new order overlaps with the slitter cutting line 20x by the slitter scorer device 7b as shown in FIG. 3. The overlapping slitter cutting lines 20x and 20y are the dividing slits Mx and My. A trim cutting line 24 is formed, by the rotary shear 2, in the trim 23y on the lower side of the new web 5y connected to the old web 5x in FIG. 3. As is apparent from the drawing, a cutting groove which has conventionally been provided in an order changing area, that is, a dividing slit N is unnecessary.

Figure 4:
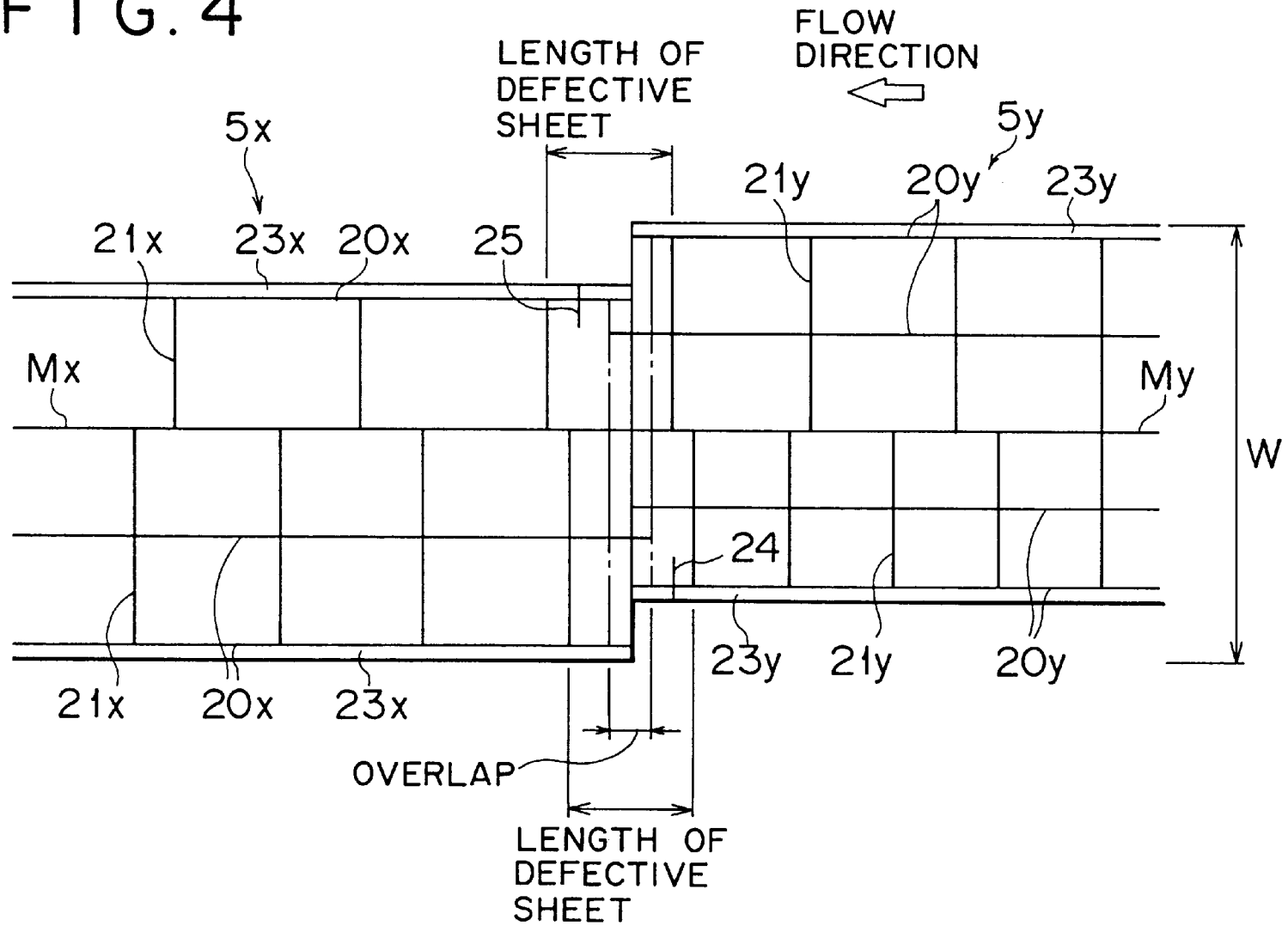
FIG. 4 is a plan view showing a corrugated fiberboard web in which a sheet taking operation has been performed by an order changing method according to another embodiment of the present invention.
Figure 5:
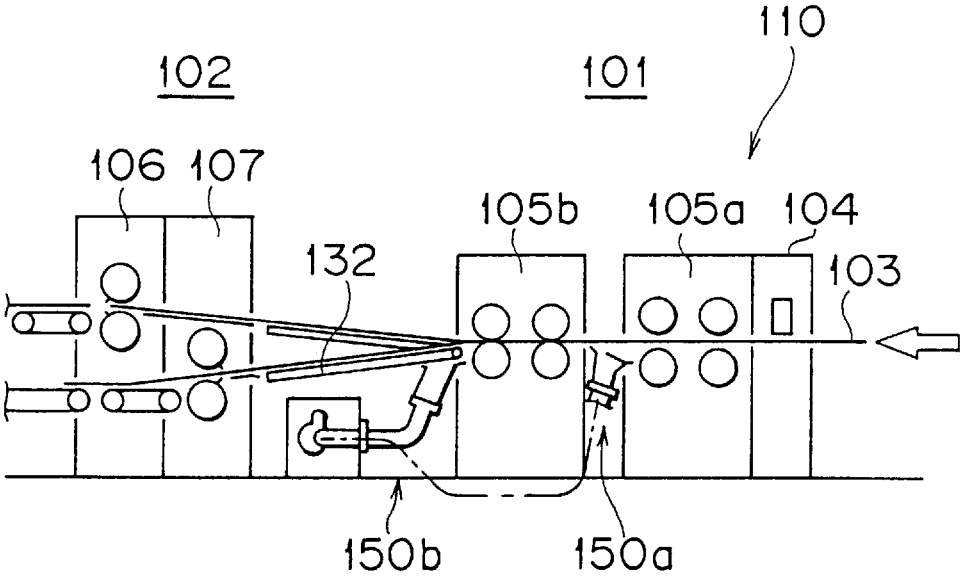
FIG. 5 PRIOR ART
FIG. 5 is a conceptual view showing a latter half part of a corrugating machine to which an order changing method according to the prior art is applied.
Figure 6:
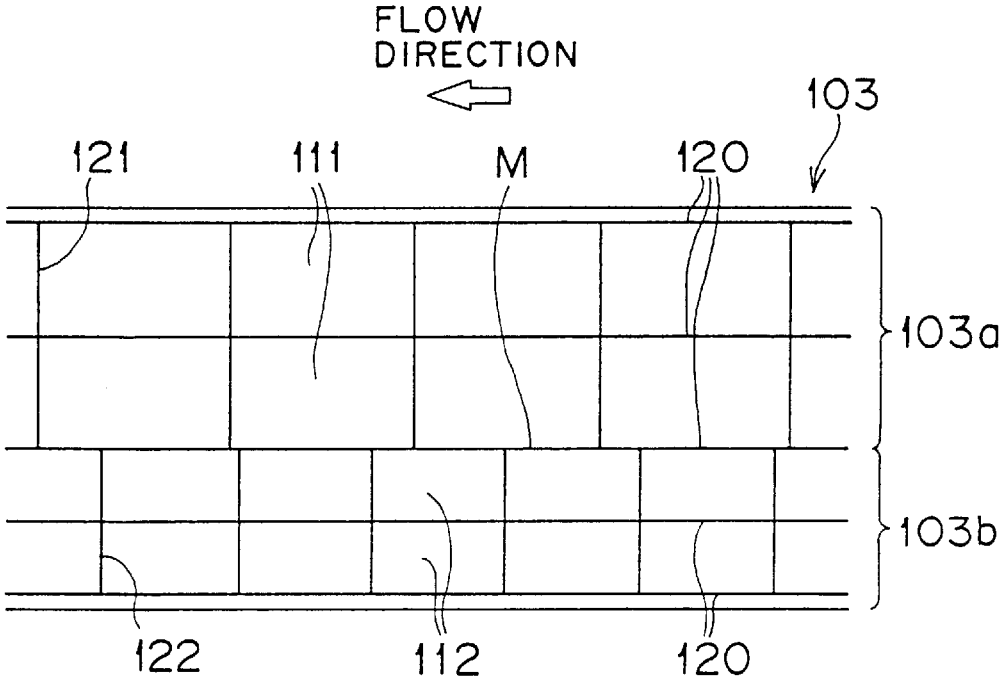
FIG. 6 PRIOR ART
FIG. 6 is a plan view showing a corrugated fiberboard web in which a sheet taking operation has been performed.
Figure 7:
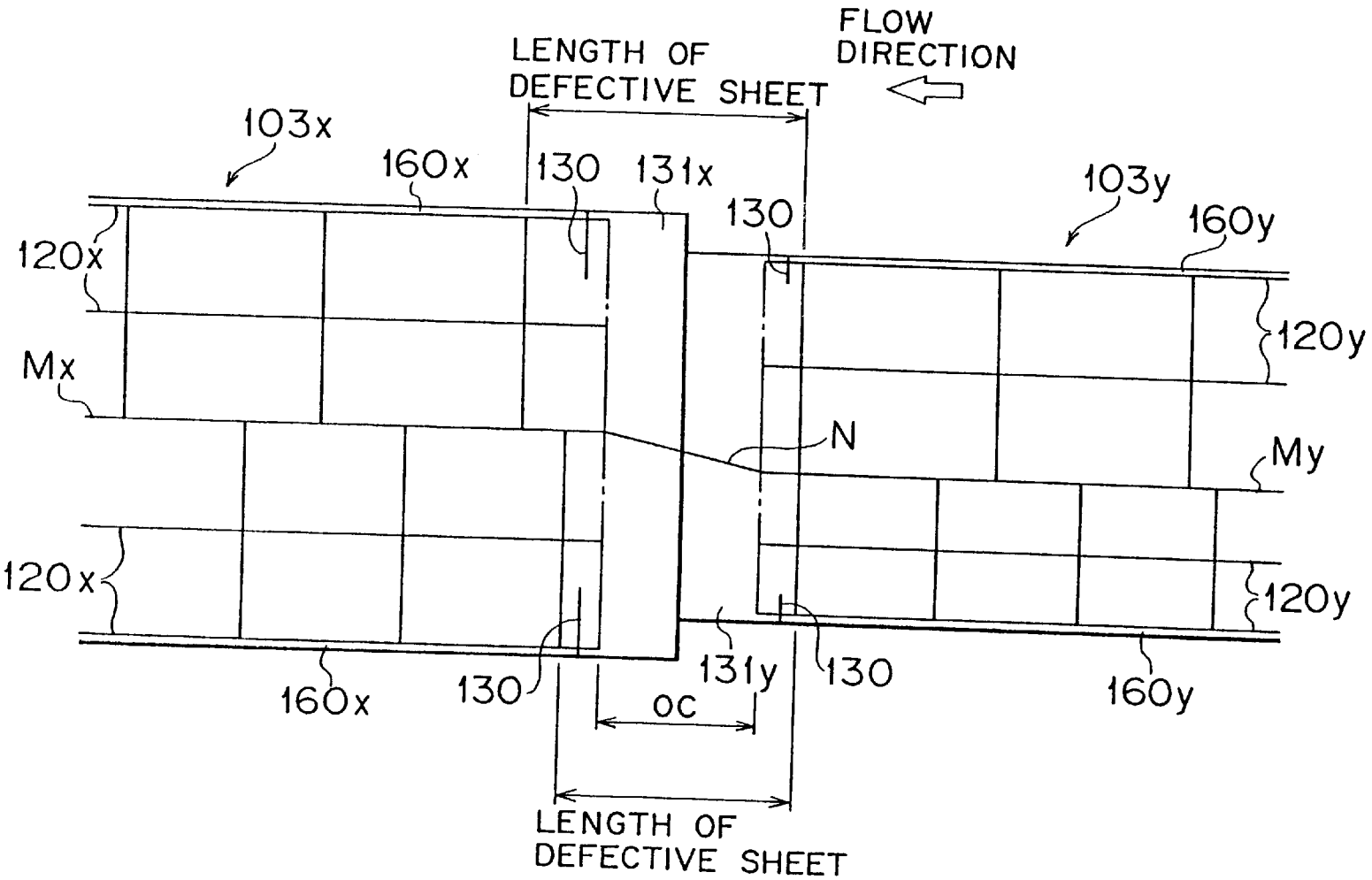
FIG. 7 PRIOR ART
FIG. 7 is a plan view showing a corrugated fiberboard web in which the sheet taking operation has been performed by the order changing method according to the prior art.

While FIG. 3 has shown the case where one of the orders keeps the same way before and after the order change, the method according to the present invention can also be applied to a case where the order change is performed in the upper and lower stages. An example of the order change in such a case is illustrated in FIG. 4. In the same manner as the example of FIG. 3, the paper patch and sheet taking arrangement of the old and new webs 5x and 5y is used such that the dividing slits Mx and My are set on almost the same straight line before and after the order change.

Although the ends of the paper are set on an almost straight line in FIG. 3, the ends of the paper patch portion make steps in FIG. 4. For this reason, a trim cutting line 25 is formed on the upper trim 23x of the old web 5x by a rotary shear 11 as shown. Others are the same as in the order changing method described with reference to FIG. 3.

In this case, if a total width W of the old and new webs exceeds a maximum width with which papers can pass through a machine as shown, the order change is performed by the above-mentioned conventional method. According to the present embodiment, consequently, the cutter 6 is provided in a conventional manner.

What is claimed is:

1. An order changing method in a corrugating machine comprising a slitter scorer device and a plurality of cut-off devices, the method comprising the steps of:

cutting an old order corrugated fiberboard web along slitter cutting lines in a running direction thereof by the slitter scorer device;

dividing the cut old order corrugated fiberboard web into at least two portions by using, as a boundary between the at least two portions, a dividing slit which is one of the slitter cutting lines wherein the dividing slit does not coincide with a centerline of the old order corrugated fiberboard web;

feeding the divided old order corrugated fiberboard web portions to the cut-off devices;

cutting and separating each of the old order corrugated fiberboard web portions thus divided in a direction orthogonal to the running direction thereof by the cut-off devices;

supplying a new order corrugated fiberboard web subsequent to the old order corrugated fiberboard web wherein the new order corrugated fiberboard web has a width different from a width of the old order corrugated fiberboard web and a dividing slit that does not coincide with a centerline of the new order corrugated fiberboard web; and substantially aligning the dividing slit of the old order corrugated fiberboard web with the dividing slit of the new order corrugated fiberboard web.

2. The order changing method according to claim 1, wherein the cut-off devices include an upper-stage cut-off device and a lower-stage cut-off device, wherein a length from an edge in a cross direction of the new corrugated fiberboard web to the dividing slit of the new order corrugated fiberboard web is substantially equal to a length from an edge in the same side of the new order corrugated fiberboard web in a cross direction of the old corrugated fiberboard web to the dividing slit of the old order corrugated fiberboard web, wherein substantially aligning the dividing slit of the old order corrugated fiberboard web and the dividing slit of the new order corrugated fiberboard web comprises adjusting said edge in the cross direction of the new order corrugated fiberboard web to the edge of the old order corrugated fiberboard web, thereby performing the order changing in either the upper-stage or the lower-stage cut-off device.

3. The order changing method according to claim 1, further comprising the step of cutting both ends in the cross direction of the old and new order corrugated fiberboard webs by the slitter scorer and sucking a trim obtained by the cutting by a trim duct.

4. The order changing method in a corrugating machine according to claim 1, wherein the step of cutting the old order corrugated fiberboard web comprises cutting the old order corrugated fiberboard web with vertically-oriented slitter knives in the slitter scorer device.

* * * * *